United States Patent [19]

Hickson

[11] 4,122,788

[45] Oct. 31, 1978

[54] SEWING MACHINE NEEDLE

[75] Inventor: James P. Hickson, Torrington, Conn.

[73] Assignee: The Torrington Company, Torrington, Conn.

[21] Appl. No.: 838,485

[22] Filed: Oct. 3, 1977

[51] Int. Cl.[2] ..... D05B 85/00
[52] U.S. Cl. ..... 112/222
[58] Field of Search ..... 112/222, 223, 224, 225; 223/102

[56] References Cited

U.S. PATENT DOCUMENTS

| | | | |
|---|---|---|---|
| 1,949,349 | 2/1934 | Brown | 112/222 |
| 3,347,192 | 10/1967 | Lukins | 112/222 |
| 3,929,082 | 12/1975 | Zocher | 112/222 |
| 3,986,468 | 10/1976 | Szostak | 112/222 |

*Primary Examiner*—George H. Krizmanich
*Attorney, Agent, or Firm*—Frank S. Troidl

[57] ABSTRACT

A sewing machine needle with special construction in the locality of the eye of the needle. The construction is such that the needle may be used in needle operations where there is very little space available between the needle and the other sewing machine elements.

2 Claims, 11 Drawing Figures

SEWING MACHINE NEEDLE

This invention relates to sewing machine needles. More particularly, this invention is a sewing machine needle with an improved structure in the locality of the eye.

Most sewing machine needles manufactured today are made, in part, by forming the blade shape with the thread grooves and eye by striking or pressing the horizontally disposed round needle blade with dies. The side walls of the blade are constrained by sections of the die from bulging laterally outward except for some lateral flash which, if formed, is later machined away, and instead the metal extrudes or flows upward and downward along the groove forming punches which move in a plane of the needle blade centerline within the dies. The needle blade cross-sectional outline takes on a relatively rectangular shape in the eye area as compared to the round shape of the original blade wire. The vertical dimension of the blade side portions laterally adjacent the grooves and eye may become greater than the original blade wire diameter, and the cross-corner dimension definitely does become considerably larger than that diameter.

This bulged section is the cause of various problems in some sewing operations. The bulged section occupies too much space, in lateral profile. Friction between needle and cloth is high, generating excessive heat with possible subsequent damage to the sewing thread, the fabric, or to the needle itself. The relatively sharp edges of the extruded sides of the needle result in the needle cutting into and/or fraying or tearing the fibers of some fabrics and sometimes in actual breakage of the fibers of a brittle fabric material. The looper and spreader must operate close to the needle to pick up the thread loop from the needle, to be sure there are no skipped stitches, but one element must not significantly interfere with the other. However, with today's high speed machines (some exceeding 8,000 stitches per minute), needle deflection from its desired location is common, due to needle "staggering" or vibration and/or to the variable pressure of the fabric against the needle as the machine operator pulls the fabric through the sewing position in his eagerness for greater production rates. The looper or spreader may impinge against the needle blade and be damaged. The needle itself may be nicked or notched or actually broken by the contact. Also, the needle may be deflected enough to hit or to wear against the throat plate, resulting in damage to either or both elements.

While some machines have needle guards to prevent a needle from being deflected into the path of the looper, the enlarged eye area of the needle slides against and abrades against the needle guard. Some machines do not even have such needle guards to prevent excessive needle deflection and to protect the needle and the looper and the spreader.

It has previously been proposed that cutting two opposed flat surfaces at the top and bottom of the needle where the thread grooves are located, starting in the eye area and symmetrically converging toward the needle tip, would eliminate the needle vibration caused by the imbalance of the needle which was due to unintentional, non-uniform and unsymmetrical needles resulting from variations in the blade pressing operations. It was also proposed that these symmetrically converging flats would increase clearance between properly positioned needle and looper and between needle and throat plate.

Unfortunately, this structure also has some drawbacks. Flats starting in the blade behind the eye and converging toward the tip do not lend themselves structurally to a smooth, well-rounded needle. There is still a relatively abrupt transition from the flat to the lateral slightly curved or bevelled side of the needle. Thus, it is possible that on some types of fabric such a needle can contribute to needle tearing or fraying of a delicate material, or actual breakage of the fibers of a brittle material.

Also, when such a needle is deflected into the path of the looper, the looper may strike nearly perpendicularly into the side of the needle under the slight rounded edge bordering the flat. There is too great a potential for damage to the needle or the looper under such condition.

Additionally, the cross-corner dimension of the needle in the slightly rounded-edged rectangular shaped eye area cross-section is still larger than it ought to be for minimum fabric interference and resultant frictional heat development.

I overcome the deficiencies, as well as the deficiencies of the other formerly known needles, with my new needles. I have found that by giving a large-radius rounding to the outer edges of the "rectangular" pressed needle shape and significantly reducing the cross-corner dimension in the eye area, and carrying this profile convergingly into the needle point area, with gradually reducing cross-sectional dimensions, that I have several benefits. I have decreased the frontal projected area presented to the fabric; and thus have greatly reduced the friction and heat generation in the sewing operation. This large-radius shape in a decreased cross-sectional blade size also contributes to a reduction in the amount of damage done to the fibers of delicate fabrics, because the fibers are not pushed so far aside as by the older well-known pressed needle and because the fibers are not bent around comparatively small-radius edges joining the lateral sides and the slabbed-off top and bottom surfaces of a needle. The large-radius cross-sectional needle profile also offers a relatively gently-angled surface for a looper to glance off a widely-deflected needle, rather than possibly striking the needle more nearly perpendicularly on one lateral side wall. Thus I can have the needle and the looper and spreader running in extremely close proximity so there will be no skipped stitches. I do not have to use the formerly necessary excessive clearance to avoid possible catastrophic damage induced by a widely deflected needle, which clearance carries with it the greater possibility of skipped stitches.

My new exterior surrounding shape may be conical or it may be in the form of a compound curved surface, such as, for example, circular or oval or rounded-off rectangular in lateral cross-section while appearing as convex curves or parallel and/or converging straight lines or a combination of these in longitudinal section.

I have also found that on some sewing machines, needles with angled surfaces or flats that are not symmetrically converging toward the needle point will allow greater clearance between the needle and the operating machine's parts than other known needles allow without increasing the probability of skipped stitches. Such non-symmetrical flats when properly formed may be better at allowing the looper to glance off a needle deflected into its path. Generally, even while utilizing these non-symmetrical flats, I would still round off the outer periphery of the needle blade at the eye area to reduce its cross-corner dimension and to maintain the smoothly contoured surface to hold down fabric damage.

The several embodiments disclosed by this invention all provide the sewing machine art and the cut-and-sew industry with a sewing machine needle which is constructed in the vicinity of the eye such that additional clearance between the needle and the other machine parts is provided when compared to conventional sewing machine needles. The needles also produce a smaller hole in the fabric as the needle penetrates, thus providing better seam appearance.

The invention, as well as its many advantages, will be further understood by reference to the following detailed description and drawings in which.

In the various Figures, like parts are referred to by like numbers.

Figure 1:
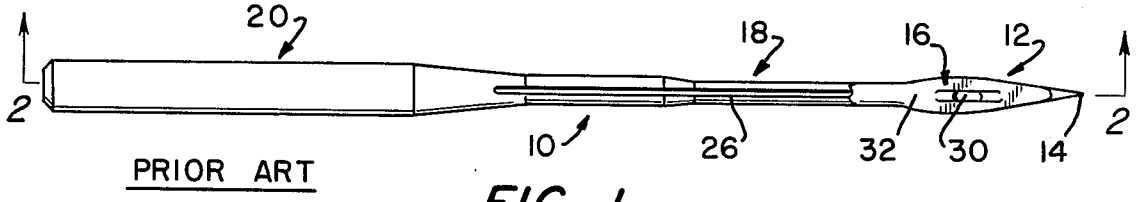
FIG. 1 is a plan view of a prior art sewing machine needle.

Referring now to the drawings and more particularly to FIG. 1 where there is shown a prior art needle 10, such as shown in U.S. Pat. No. 3,986,468 granted October 19, 1976. The needle 10 is constructed of a suitable material, such as steel, and comprises a conical shaped leading end portion 12 which terminates at its leading end in a sharp point 14; an eye portion 16; a blade portion 18; and a butt ended shank portion 20.

Figure 2:
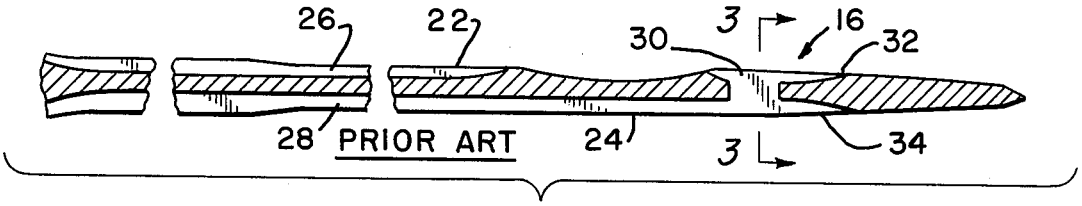
FIG. 2 is a view in cross-section, taken along lines 2—2 of FIG. 1.
Figure 3:
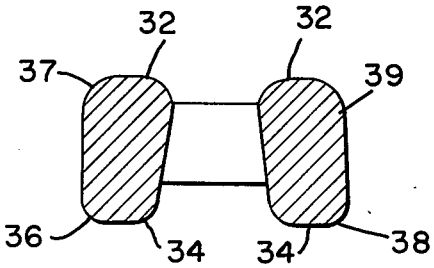
FIG. 3 PRIOR ART
FIG. 3 is a view taken on lines 3—3 of FIG. 2.

As may be best seen in FIG. 2, two oppositely disposed flat sides 22 and 24 have top and bottom thread grooves 26 and 28 along the blade portion. The grooves 26 and 28 are centered on the flat sides 22 and 24. A needle eye 30 is also created by piercing through the leading or front end of the blade portion thereby forming the needle eye portion 16.

Two tapered flat surfaces 32 and 34 are provided on both sides of the needle, beginning at a point slightly rearward of the needle's eye and symmetrically converging towards the point of the needle. The corners 36, 37, 38, and 39 are small radius corners.

Figure 4:
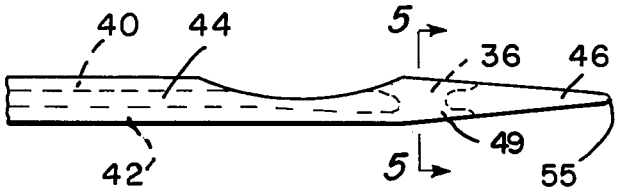
FIG. 4 is a fragmentary side view showing one preferred embodiment of the invention.
Figure 5:
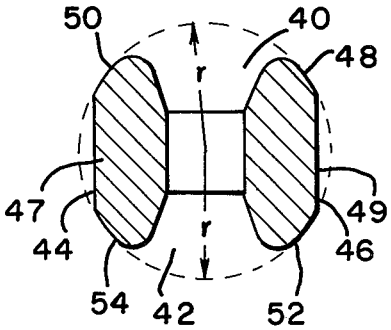
FIG. 5 is a sectional view, on an enlarged scale, taken along lines 5—5 of FIG. 4 and in the direction of the arrows.

A preferred embodiment of this invention is shown in FIG. 4 and FIG. 5. The eye 36 extends through the needle from the top groove 40 to the bottom groove 42. The eye is located in the area of the front end of the blade 44 and the back end of the leading end portion 46. A pair of side portions 47 and 49 are formed by the formation of the grooves 40 and 42 and the eye 36. Each side portion of the needle comprises a small vertical flat central surface 44 and 46. At least one large-radius curved surface is also provided on each side portion 47 and 49. In the embodiment of FIG. 4 and FIG. 5, each side is provided with two curved surfaces. Curved surfaces 48 and 50 extend from the flat surfaces 46 and 44, respectively, to the top of the needle and curved surfaces 52 and 54, respectively, extend from the flat surfaces 46 and 44, respectively, to the bottom of the needle and are blended in smooth curves to those surfaces and into the groove side wall surfaces. Preferably, the curved surfaces 48, 50, 52, and 54 at any one longitudinal portion on the needle are on a common circle having a radius (*r*) and having a center on the longitudinal axis of the needle. All of the outer curved surfaces which start in the area of the eye 36 convergingly taper toward the tip 55, not always at a constant angle.

Thus, the new needle with the radiused surfaces allows the looper to glance off it the needle should be deflected into the path of the looper. Also, a smaller hole in the fabric is made as the needle penetrates the fabric, and fabric damage is reduced.

Figure 6:
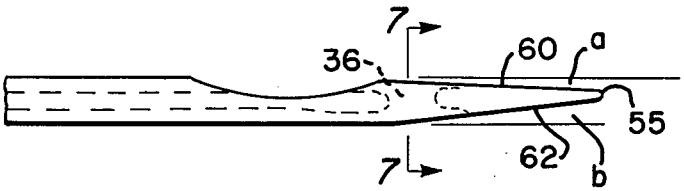
FIG. 6 is a fragmentary side view of another preferred embodiment.
Figure 7:
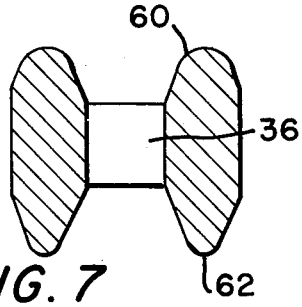
FIG. 7 is a sectional view, on an enlarged scale, taken along lines 7—7 of FIG. 6 and in the direction of the arrows.

In the embodiment shown in FIG. 6 and FIG. 7, the top and bottom of the needle converge at different angles toward the point of the needle. In the needle shown, the converging of the top 60 of the needle begins at or behind the area of the eye 36, and the converging of the bottom 62 of the needle begins at or in front of the area of the eye and extends toward the tip 55 of the needle, the angle (*a*) being smaller than the angle (*b*). In some needles, these angles are reversed.

Figure 8:
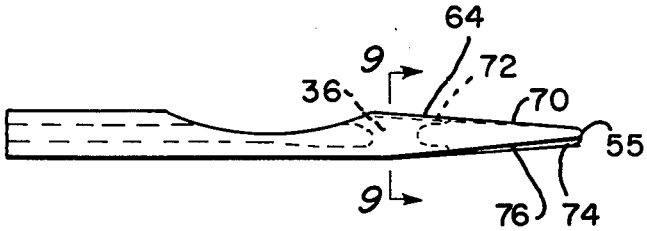
FIG. 8 is a fragmentary side view of still another preferred embodiment.
Figure 9:
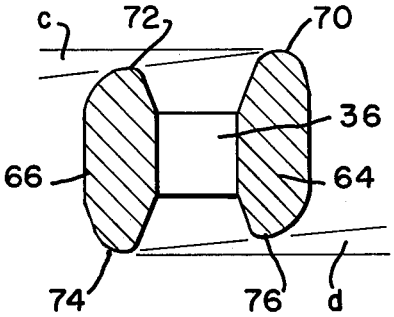
FIG. 9 is a sectional view, on an enlarged scale, taken along lines 9—9 of FIG. 8 and in the direction of the arrows.

In the embodiment shown in FIG. 8 and FIG. 9, the top 70 of side portion 64 extends further from a horizontal plane through the axis of the needle than the top 72 of the other side portion 66. The bottom 74 of side portion 66 extends further from the horizontal plane through the axis of the needle than the bottom 76 of side portion 64.

The tops 70 and 72 of the side portions are flat with rounded edges and lie along a plane extending at an acute angle (*c*) to a horizontal plane. Instead of being partially flat, they may be rounded with large-radius curves as in FIG. 5 which are blended around into the surfaces of the grooves. The bottoms 74 and 76 of the side portions 66 and 64, respectively, are flat with rounded edges and lie along a plane extending at an acute angle (*d*) to a horizontal plane. Alternatively, these bottom surfaces may also be well-rounded. The angles (*c*) and (*d*) open in opposite directions. The side portions 64 and 66 convergingly taper toward the tip 55, but not always at a constant angle.

Figure 10:
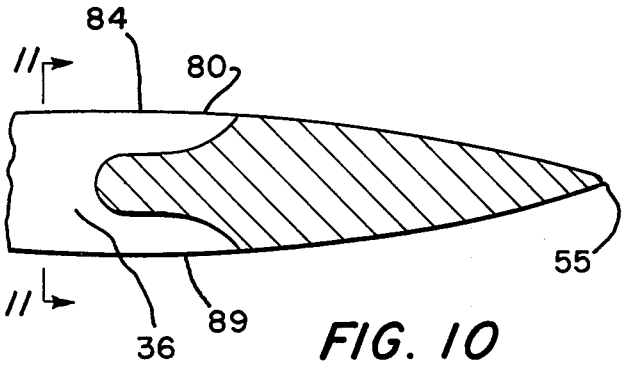
FIG. 10 is a fragmentary side view, in longitudinal cross-section, of still another preferred embodiment.
Figure 11:
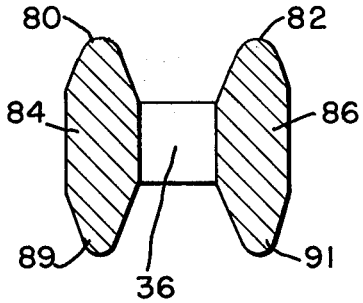
FIG. 11 is a sectional view, on an enlarged scale, taken along lines 11—11 of FIG. 10 and in the direction of the arrows.

In the embodiment shown in FIG. 10 and FIG. 11, the tops 80 and 82 of side portions 84 and 86, respectively, are generally convex in longitudinal cross-section, and the bottoms 89 and 91 of side portions 84 and 86 are also generally convex in longitudinal cross-section. The convex shape starts in the area of the eye 36 and extends toward the tip 55.

I claim:

1. In a sewing machine needle having a leading end, a blade, and a shank for fitting the needle into a sewing machine needle holder, said needle having an eye located in the area of the front of the blade and the back of the leading end and extending from the top to the bottom of the needle: the top of one side portion of the needle formed by the eye extends further from a horizontal plane through the axis of the needle than the top of the other side portion, and the bottom of said other side portion extends further from said horizontal plane than the bottom of said one side portion, and the side portions convergingly taper toward the needle tip.

2. A sewing machine needle in accordance with claim 1 wherein: the tops of the side portions are flat and lie along a plane extending at an acute angle to a horizontal plane, and the bottoms of the side portions are flat and lie along a plane extending at an acute angle to a horizontal plane, the opening directions of said two acute angles being in opposite directions.

* * * * *